US005669194A

United States Patent [19]

Colasanto et al.

[11] Patent Number: 5,669,194

[45] Date of Patent: Sep. 23, 1997

[54] STRUCTURAL SYSTEMS FOR SUPPORTING A BUILDING UTILIZING LIGHT WEIGHT STEEL FRAMING FOR WALLS AND HOLLOW CORE CONCRETE SLABS FOR FLOORS

[75] Inventors: Thomas Colasanto, Commack, N.Y.; Thomas Nastasi, Jr., 331 Wheatley Rd., Old Westbury, N.Y. 11568

[73] Assignees: Marco Consulting, Inc., Commack; Thomas Nastasi, Jr., Old Westbury, both of N.Y.

[21] Appl. No.: 523,010

[22] Filed: Sep. 1, 1995

Related U.S. Application Data

[60] Division of Ser. No. 94,697, Jul. 22, 1993, Pat. No. 5,479,749, which is a continuation-in-part of Ser. No. 999,431, Dec. 31, 1992, Pat. No. 5,402,612, which is a division of Ser. No. 493,794, Mar. 15, 1990, Pat. No. 5,113,631.

[51] Int. Cl.[6] ..... E04B 1/02

[52] U.S. Cl. ..... 52/236.8; 52/236.9; 52/259; 52/262

[58] Field of Search ..... 52/236.5, 236.7, 52/236.8, 236.9, 258, 259, 250, 334, 262, 272

[56] References Cited

U.S. PATENT DOCUMENTS 3,872,635 3/1975 Miram ..... 52/236.8

4,461,130 7/1984 Shubow ..... 52/236.8

4,716,695 1/1988 Alexander et al. ..... 52/272

FOREIGN PATENT DOCUMENTS 8802803 4/1988 WIPO ..... 52/236.8

*Primary Examiner*—Michael Safavi

*Attorney, Agent, or Firm*—Galgano & Burke

[57] ABSTRACT

An improved structural system for supporting a building includes prefabricated light weight steel framed bearing wall panels supporting hollow core concrete slabs which are joined with grout. The invention presents improved devices for attaching exterior finishing to exterior bearing walls without requiting a studded non-bearing exterior wall, improved attachment devices for connecting upper level and lower level bearing walls, improved design of bearing walls to eliminate the need for bearing plates between studs and tracks, and an improved splice member for aligning reinforcing bars. The exterior finish mounting device includes a deck stud channel which is mounted to a reinforcing bar by a channel clip and secured in grout by a gusset plate with a hole in it. The exterior finish is attached to the stud channel by screws which are also secured in the grout. Flat metal straps welded to the tops of double studs eliminate the previously used threaded members with angled bearings, nuts and washers. The studs are ground at their ends to fit more perfectly within tracks and avoid the need for bearing plates. An open slide clip replaces the former splice member to allow for more latitude in positioning reinforcing bars and providing a better surface area for grout.

6 Claims, 10 Drawing Sheets

STRUCTURAL SYSTEMS FOR SUPPORTING A BUILDING UTILIZING LIGHT WEIGHT STEEL FRAMING FOR WALLS AND HOLLOW CORE CONCRETE SLABS FOR FLOORS

This is a divisional of application(s) Ser. No. 08/094,697 filed on Jul. 22, 1993 now U.S. Pat. No. 5,479,749, which, in turn is a continuation-in-part of Ser. No. 07/999,431 filed Dec. 31, 1992 now U.S. Pat. No. 5,402,612; which, in turn, is a divisional Ser. No. 07/493,794 filed Mar. 15, 1990 of U.S. Pat. No. 5,113,631,issued May 19, 1992; and is related to U.S. Pat. No. 5,195,293 issued Mar. 23, 1993.

BACKGROUND OF THE INVENTION

This invention relates in general to prefabricated buildings and, more particularly, to a building that utilizes preferably prefabricated, cold formed steel wall panels and prefabricated, hollow core concrete floor slabs. When completed, the prefabricated walls and floor slabs provide a structural support system for the building. The invention also relates to a method for fabricating and erecting such a support system.

In low rise multi-story buildings having steel structural support systems, prefabricated light weight steel framing (L.W.S.F.) is predominantly used. The basic building component of light weight steel framed structures is the cold formed shape. The use of light weight steel framing was heavily influenced by wood framing. The "2 by" member, e.g., "2×4", of wood framing was simply replaced with a cold formed "C" or "Z" shaped, thin steel section. In building design, prefabricated, light weight steel framed wall panels are divided essentially into two categories: (1) curtain wall and (2) load bearing. Curtain wall studs are flexural members used in non-bearing, exterior wall panels that are designed to resist only wind loads, axial loads due to the weight of the curtain wall itself and the weight of finishes only. These members provide structural support for a variety of exterior finishes including masonry veneer, stucco, synthetic veneers and exterior insulation with finish systems.

Interior finishes such as gypsum wall board may be attached directly to the light weight steel framing. A typical stud wall is arranged between floor slabs. The bottom of each wall stud is located in a bottom track while the top of the stud is located in an inner track, which is received within an outer top track. The tracks are typically connected to the floor slabs by drilled expansion anchors.

A total load bearing system constructed from light weight steel framing includes studs and planks. A load bearing stud is designed to support axial and wind loads while a joist is designed to support the interior dead load and live load of the building. A known type of construction for a light weight steel framed building is comprised of axial load bearing studs, joists, and rafters for platform type construction. In platform type construction each floor acts as a working platform for the construction of the next story. Axial load bearing studs are located between the top and bottom tracks. Concrete stops or subfloor edge supports are arranged at the inner side of the bottom tracks for defining the ends of a floor, which may be constructed from plywood or poured concrete. Studs have "C" shaped cross sections defined by a web, two flanges connected to the ends of the web and lips connected to the free ends of the flanges to stiffen the flanges.

In low rise concrete buildings, the hollow core slab system of construction has been used. The basic component of the hollow core slab system of construction is a prefabricated, prestressed concrete member or slab having a series of continuous voids. The slabs may be arranged to form walls, floors, roof decks and spandrel panels. Hollow core slabs are most widely known for providing economical floor and roof systems. The most common use of hollow core slab is found in "block and plank" structures where the prefabricated, hollow core slabs form the floors and roof, which are supported by concrete block walls. Finishes may be applied directly to the top and/or underside surface of the hollow core slabs.

The continually rising cost of building construction and the longstanding need for affordable housing have motivated the building design community to consider alternative construction materials and methods of constructing low rise multi-story buildings. In the past, the use of a steel structures or concrete structures, such as those described above, have dominated the building industry.

Parent application Ser. No. 07/999,431 solves many of the problems associated with these prior structural support systems to significantly reduce construction costs and satisfy the need for affordable housing. This is accomplished by combining the most cost effective component of the prefabricated, steel stud building system with the most cost effective component of the prefabricated, concrete system to provide a unique structural support system. The stud is the most efficient component of the light weight steel framing system because it is a stiffened channel that has tremendous axial load capabilities for its relatively light weight. The plank or slab is the most efficient component of the hollow core slab system because the prestressed concrete plank provides efficient load carrying capacity and deflection control, particularly when used for floor and roof systems.

The parent application describes a structural system for supporting a building having a first level of preferably prefabricated, light weight steel framed, bearing wall panels, each having a bottom end attached to a foundation and a top end for supporting a floor, in which the bearing wall panels are spaced at predetermined intervals in a first direction along the foundation. A first level of prefabricated, hollow core concrete floor slabs having longitudinal sides and transverse ends is positioned upon the top ends of adjacent bearing wall panels such that the longitudinal sides of longitudinally adjacent slabs form keyways extending parallel to the first direction and the transverse ends of transversely adjacent slabs form butt joints extending perpendicular to the keyways. A plurality of connection members positively interlock the bearing walls to the slabs thereby forming a unitary structure in which the floor slabs and bearing walls are interlocked.

In particular, the parent application provides for splice plates attached to the top ends of the wall having at least one hole aligned with a respective keyway. Each keyway includes at least one first reinforcing bar received in the aligned hole of the splice plate and each butt joint may include at least one second reinforcing bar extending parallel to the butt joint. The keyways and butt joints are filled with grout. Each splice plate may include a number of holes that automatically accommodate for tolerances during construction. A similar type of connection may be provided at the exterior bearing wall to floor slab connections.

A first set of preferably prefabricated, exterior non-bearing wall panels may be attached to the foundation and to the first level of floor slabs in a position perpendicular to the bearing wall panels, while a second set of exterior non-bearing walls may be attached to the foundation and to the exterior bearing walls in a position parallel to bearing wall panels. The first set of exterior non-bearing walls may be attached after installation of the first level of bearing wall panels and floor slabs or after additional stories are installed. The second set of exterior non-bearing walls also may be attached after installation of the first level of bearing walls and floor slabs or after additional stories are installed. Alteratively, the second set of exterior non-bearing walls may be attached to the exterior bearing wall panels during prefabrication.

When multi-story buildings are being constructed, a second level of preferably prefabricated, bearing wall panels is attached to the first level of floor slabs such that the second level studs are in vertical alignment with the first level studs of bearing wall panels below. A second level of floor slabs then is positively interlocked with the second level bearing walls in the same manner as first level panels discussed above. Shims may be inserted between the first level of floor slabs and the bottom end of the second level bearing wall panels to eliminate any spacing therebetween to provide for full bearing connections.

The structural support system of the parent application also provides a unique connection between cross bracing at the bearing wall to floor slab intersections. The cross bracing is formed from flat straps, diagonally attached to each side of a predetermined number of bearing walls in an "X" shape during prefabrication of the wall panels. The bottom of the first level of cross bracing is attached to the foundation. Wind posts, which may be formed as double stud combinations in the bearing wall, are provided at all post locations of the cross bracing. Wind posts of the second level bearing wails provided with cross bracing are in vertical alignment with the wind posts of the first level, cross braced, bearing wall panels. The vertically aligned wind posts of each level are directly connected to each other for transferring loads. The connection may be formed by at least one vertical, threaded rod and bolt provided in the butt joint between transverse ends of adjacent slabs. The threaded rods may be connected between the wind posts by bearing angles attached to the wind posts.

The parent application also includes improvements in the light weight steel framed bearing wall panels used in the invention, but which may be employed in other types of support systems, as well. By grinding the edges of the bearing plates, which are placed between the ends of the load bearing studs and the cold formed, continuous steel tracks of the bearing wall panels, the bearing plates lie flush against the web of the track. Without grinding, the plates are spaced from the web of the track by the curved comers of the tracks, which are formed during the cold forming process. With the bearing plates lying flush against the web, the full bearing capacity of the plate may be employed, thereby enabling a decrease in the amount of steel required in the support system without decreasing the load-carrying capacity of the wall.

The positive connection between bearing wall panels and floor slabs is made by welding or mechanically fastening a bearing plate to the top of the bearing walls and then welding or fastening the bearing plate to embedded plates provided in the floor slabs. The floor slabs rest upon the overhanging outer portions of the bearing plate and the upper level wall is connected directly to the bearing plate. Alternatively, the bearing wall-floor slab connection is made by cutting grooves in the top surface of the floor slabs. The grooves extend parallel to the butt joints and communicate with the butt joints such that poured grout fills the grooves and butt joints to form a level surface upon which the upper level wall is connected. Alternatively, the bearing wail-floor slab connection is made by welding or mechanically fastening embedded plates provided in the floor slabs directly to the top track of the bearing wall.

While the structures taught in the parent application indeed provide many advantages, several important improvements have recently been devised.

SUMMARY OF THE INVENTION

It is therefore an object of the present invention to further improve on the structures taught by the parent application.

In particular, with regard to the attachment of an exterior non-bearing wall panel having studs to an exterior bearing wall panel in order to support an exterior finish wall, the present invention provides means for eliminating the exterior non-bearing wall studs and attaching the exterior finish wall directly to the exterior bearing wall panel. This is accomplished by providing a deck stud channel at an upper portion of the exterior finish wall and attaching the channel to the top of the exterior stud wall beneath the floor plank. This automatically gauges the distance between the floor and the exterior finish wall avoiding the need for an exterior non-bearing stud wall panel.

To further enhance the connection between the stud wall and the exterior finish wall, a new channel clip has been devised which enables the easy placement and positive lock of the reinforcing bar. A plurality of screws from the exterior finish wall through the deck stud channel act as reinforcing members to the floor grout making the connection of the floor and deck stud channel monolithic.

By eliminating the exterior non-bearing stud wall, the cost of the exterior bearing wall construction materials is reduced approximately 30%, the cost of labor is reduced by more than 60%, and the weight of the materials is reduced by approximately 15%. Moreover, by eliminating one of the exterior walls, there is no longer any need to align two walls for window installation. Exterior wall thickness is reduced by 62% and the great risk of error in gauging the floor space to a set dimension is eliminated. Despite irregularities in floor thickness, all exterior wall panels can be sized similarly without the need of shimming for irregular floors.

The addition of a gusset clip to the deck stud channel further enhances the strength of the grout-to-steel interface by having a hole in the gusset through which grout flows. The gusset clip also enables the deck stud channel to remain perpendicular to the stud wall track.

Another improvement of the present invention allows for the elimination of the threaded rods extending through the butt joints of the hollow core slabs adjacent a stud wall. These rods were previously attached to upper and lower adjacent stud walls as a bolt and nut connection through bearing angles mechanically fastened to wind posts. By replacing these bearing angles, rods, nuts and washers with flat straps welded to the sides of wind posts, the cost of materials for this connection is reduced by 95%. The cost of labor in making the connection is reduced by 50%. The weight of the connection is reduced by 85% and the risk of failure is reduced since there are no bolts which can come loose.

Yet another improvement of the present invention allows for the elimination of bearing plates between studs and tracks and a reduction in the number of mechanical fasteners located within top and bottom tracks and hollow core slabs. By grinding the edges of the studs so that they fit directly against the top and bottom track, the upper and lower bearing plates are no longer needed. Moreover, by eliminating the bearing plates, only one staggered mechanical fastener between the track and the floor slab is needed every two feet. The elimination of the bearing plates and half of the fasteners results in a reduction of 5% in the cost of materials, 20% reduction in the labor cost during prefabrication and a 5% reduction in the labor cost of field installation for this connection.

Still another improvement of the present invention involves redesigning the splice plate as an open slide clip. This allows for even more latitude in the placement of reinforcing bars, reduces the cost of the clip (splice plate) by 64% and reduces the weight of the clip by 31%. The large surface area of this newly designed integration clip enables the grout to achieve a higher mating arrangement.

Further features, advantages and embodiments of the invention are apparent from consideration of the following detailed description, drawings and appended claims.

DETAILED DESCRIPTION

Figure 1:
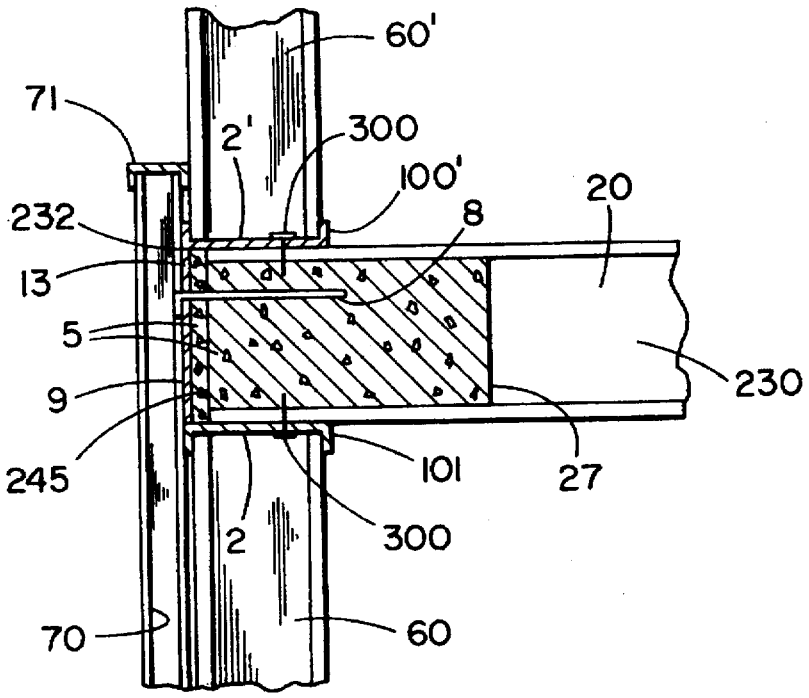
FIG. 1 is a broken, sectional view showing the typical intersection of hollow core slabs and an exterior bearing wall panel as taught by the parent application.

FIG. 1 is a broken, sectional view showing the typical intersection of hollow core slabs and an exterior, light weight steel framed, bearing wall panel, i.e., a bearing wall disposed at an end of the structure. Numeral 60 depicts a typical end bearing stud, which rests on a bearing plate 2 in a continuous track section 101 provided at the top of the exterior bearing wall panel. Fastener 300 is connected from below through the bearing plate 2 and the continuous track 101 into the hollow core floor slab 230. The splice plate 9 is connected to the outer edge of the top of track 101 to enable the hollow core slab 230 to bear upon a greater portion of the exterior wall system or the wall studs 60, thereby reducing the introduction of an eccentric loading condition into the stud wall 60, which would occur if the splice plate were connected at the middle of track 101, as is the case with the interior bearing wall panels. A reinforcing bar 8 is bent 90 degrees at its outer end to hold the hollow core slab 230 in place with the splice plate 9 after the addition of grout 5. An exterior non-bearing wall panel having studs 70 held in tracks 71 (for supporting an exterior finish) is connected to the exterior bearing wall panel 60 by mechanical fasteners or welding before or after the installation of hollow core slab 230 or during prefabrication of the walls. A thin flat steel plate 13 extends from the top of the hollow core slab 230 to the top of continuous track section 101. Plate 13 closes the butt joint 245 formed with the outer transverse end 232 of slab 230 to enable the pouring of the grout 5 into this space and into the hollow cores 26 of the slab 230 (up to grout stop 27) without the grout spilling down between the exterior wall studs 60, 70. Plate 13 includes a hole (not shown), which aligns with the holes in splice plate 9, for receiving bar 8. Once the grout 5 is cured, the installation of the upper wall panel having studs 60' can be completed. Studs 60' are attached by mechanically fastening the bottom track 100' of the upper wall with the hollow core slab 230.

Figure 2:
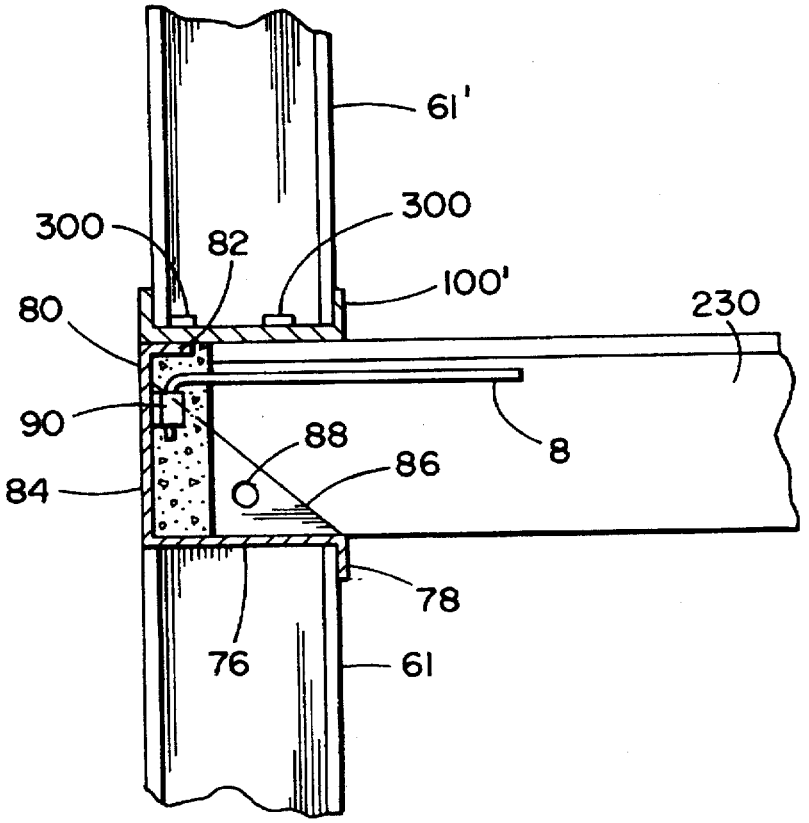
FIG. 2 is view similar to FIG. 1 showing the deck stud channel and channel clip of the present invention.
Figure 3:
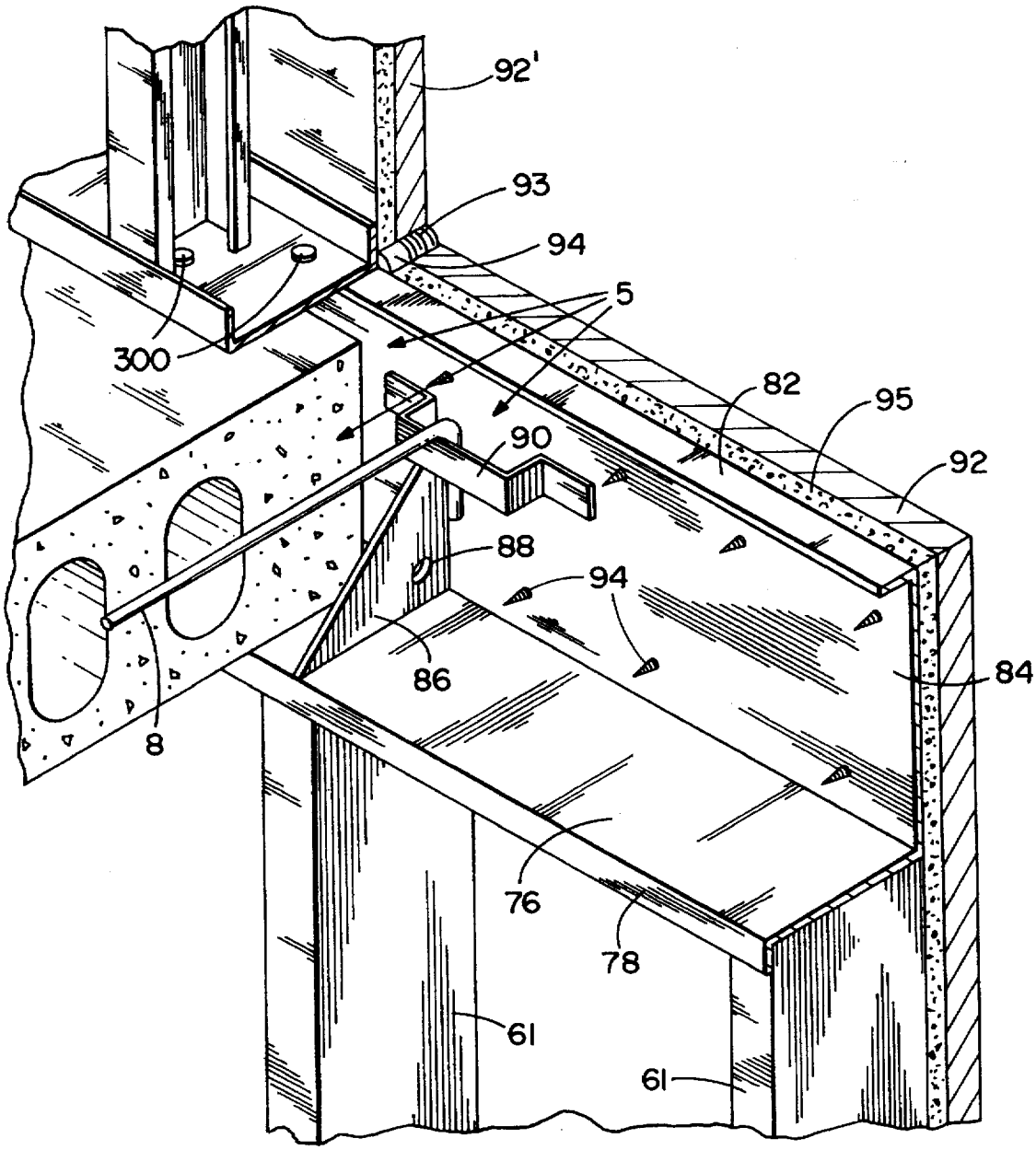
FIG. 3 is a broken isometric view of the deck stud channel of the present invention installed in an exterior bearing wall.
Figure 3A:
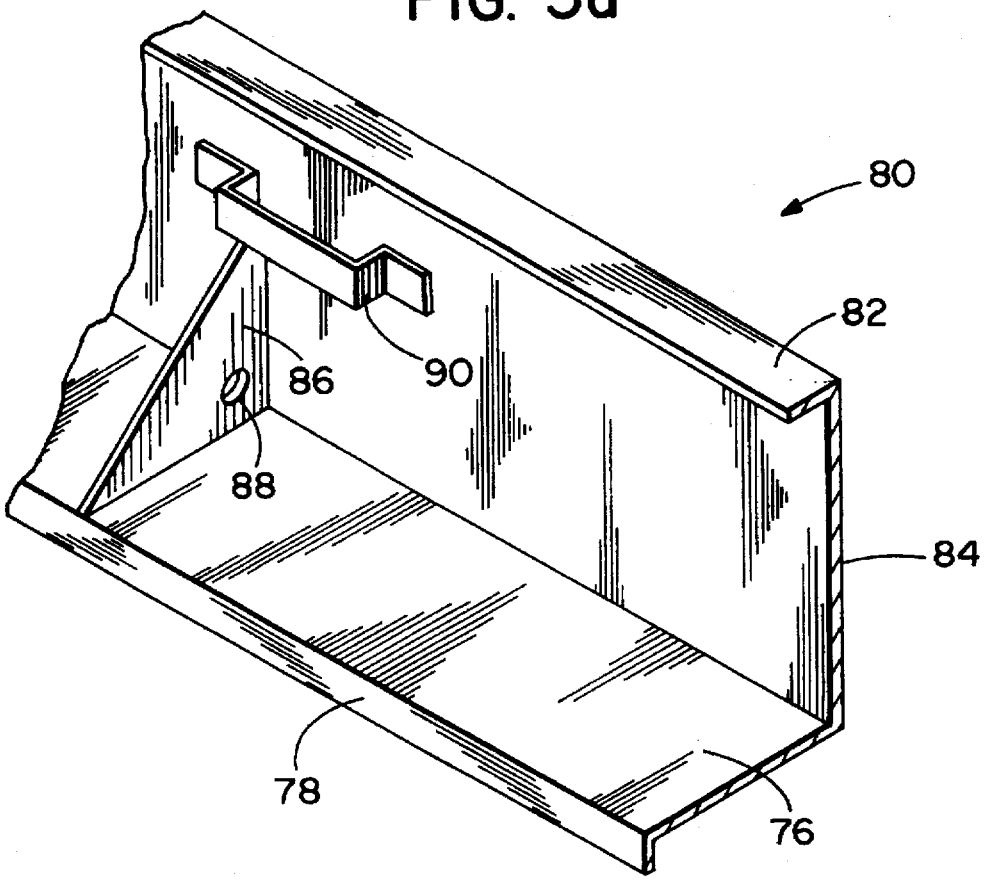
FIG. 3A is a view similar to FIG. 3, but showing only the deck stud channel of the invention.

The present invention eliminates the need for exterior non-bearing wall studs 70, splice plate 9, flat steel plate 13, and wall track 101 by providing a deck stud channel 80 as shown in FIGS. 2, 3, and 3A. Deck stud channel 80 is a cold rolled steel angle member (shaped or profiled) having an upper horizontal portion 82, an outer vertical portion 84, a lower horizontal portion 76 and a depending inner vertical portion 78. A plurality of interior gussets 86 (FIG. 3) having holes 88 provide horizontal and vertical edges which rest above the lower horizontal portion 76 and outer vertical portion 84 to maintain perpendicular configuration of the stud channel 80. An interior stud channel clip 90 receives the bent end of reinforcing rod 8. Exterior substrate 95 is attached to the deck stud channel 80 by screws 94 which preferably protrude through the stud channel into the space above the lower horizontal portion 76. After the deck stud channel is "hung" by the lower horizontal portion 76 placed on top of studs 60, and reinforcing bar 8 is inserted as shown, grout 5 is applied to the space between the reinforcing bar 8, slabs 230, and the outer vertical portion 84 of the deck stud channel 80. The gusset 86 provides added support by hole 88 through which grout 5 passes and later hardens to bond the gusset with surrounding parts. Screws 94 from the exterior substrate 95 also bond with grout 5 enhancing the connection of the stud channel to the floor slabs 230.

After the grout hardens, the deck stud channel 80 automatically gauges assembly of the next story stud wall 61' by the position of its horizontal top portion 82. The bottom track 100' of the next story stud wall is shimmed as needed and then mechanically fastened both to the slabs 230 and to the upper horizontal portion 82 of the stud channel 80 as shown best in FIG. 3. The operation is repeated for each successive story and the exterior finish panels 92, 92', etc. are sealed with caulk 93 and backer rod 94.

Figure 4:
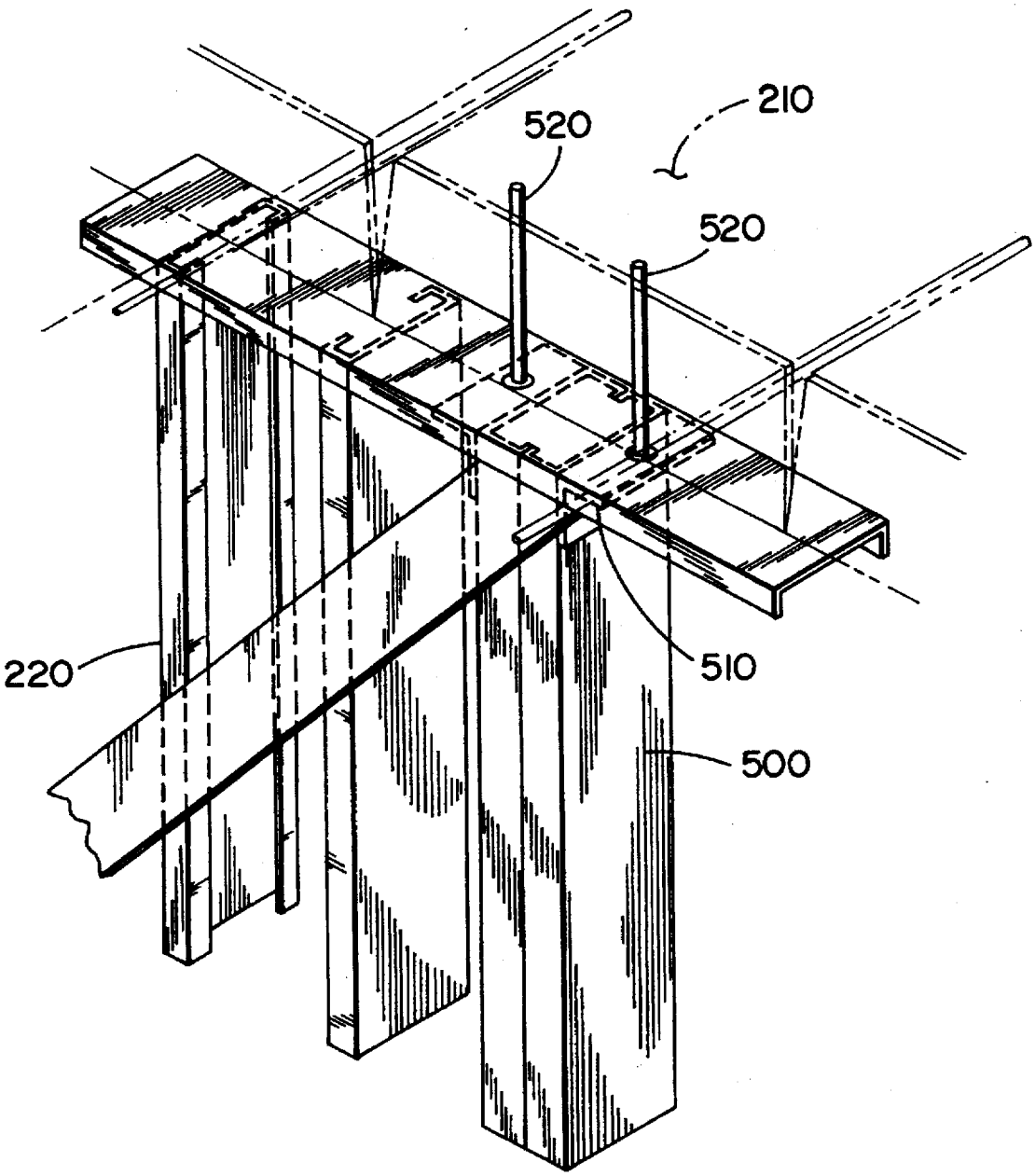
FIG. 4 is a partially constructed, broken, isometric view of the connection between floors as taught by the parent application.
Figure 5:
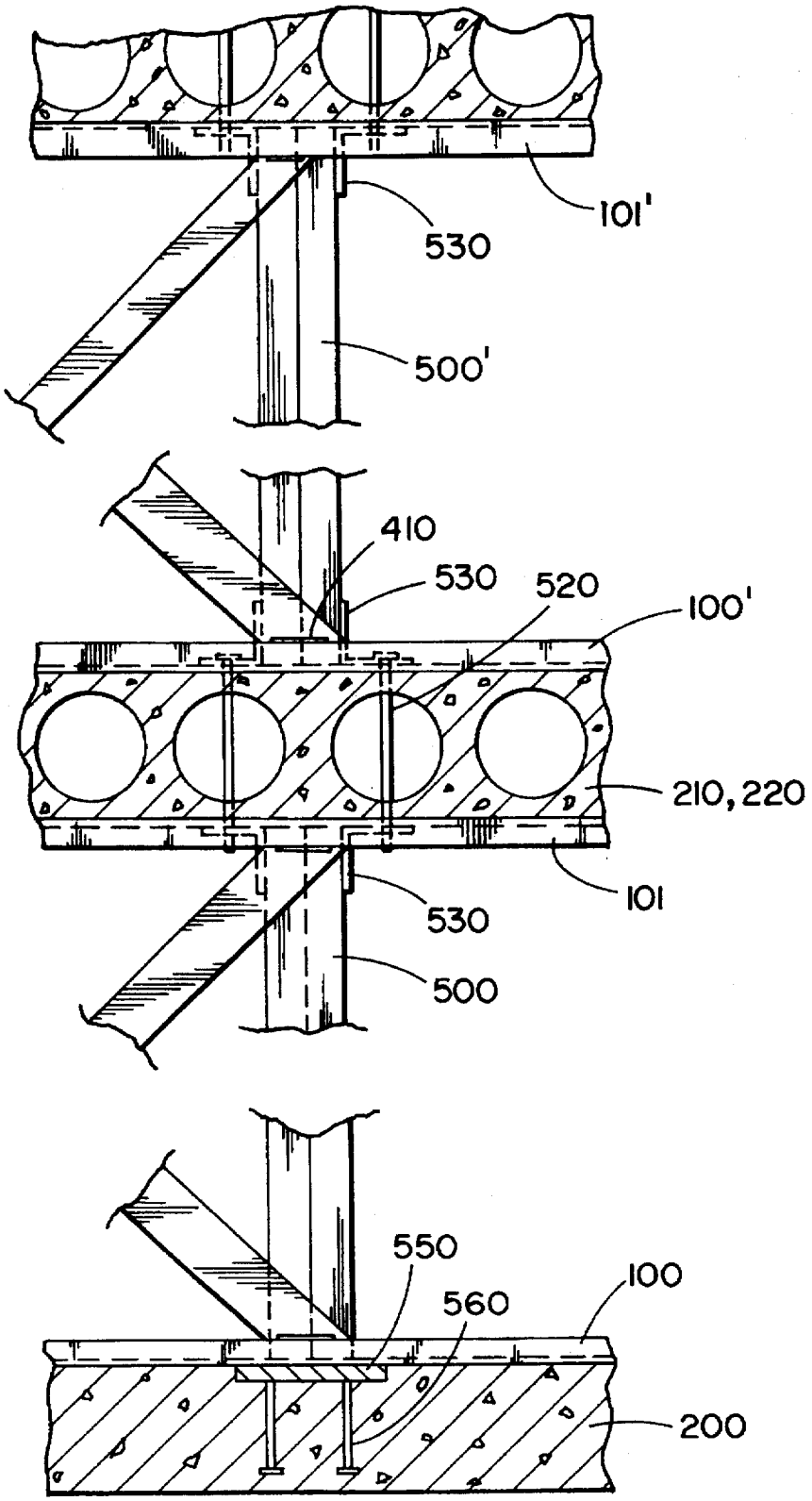
FIG. 5 is a broken, sectional view showing connections between several floors as taught by the parent application.

FIGS. 4 and 5 show the threaded rods 520 which project through the butt joints in the hollow core slab system to connect an upper wind post 500' aligned vertically above the wind post 500 below as taught by the parent application. The assembled bolt and nut connection of the threaded rod 520 extending through the floor system and through the bearing angles 530, requires a substantial amount of hardware and assembly.

Figure 7:
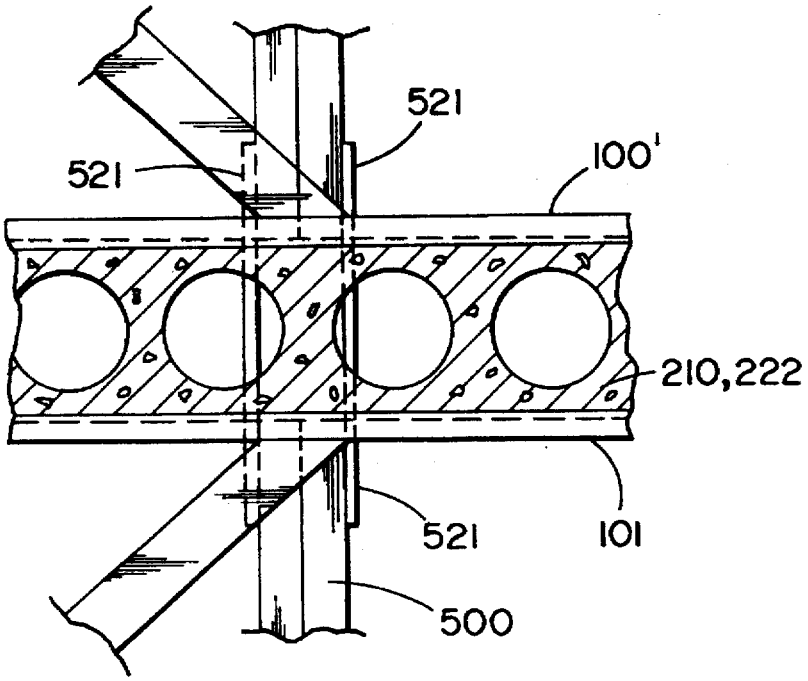
FIG. 7 is a view similar to FIG. 5 showing the improved connection between floors according to the present invention.
Figure 6:
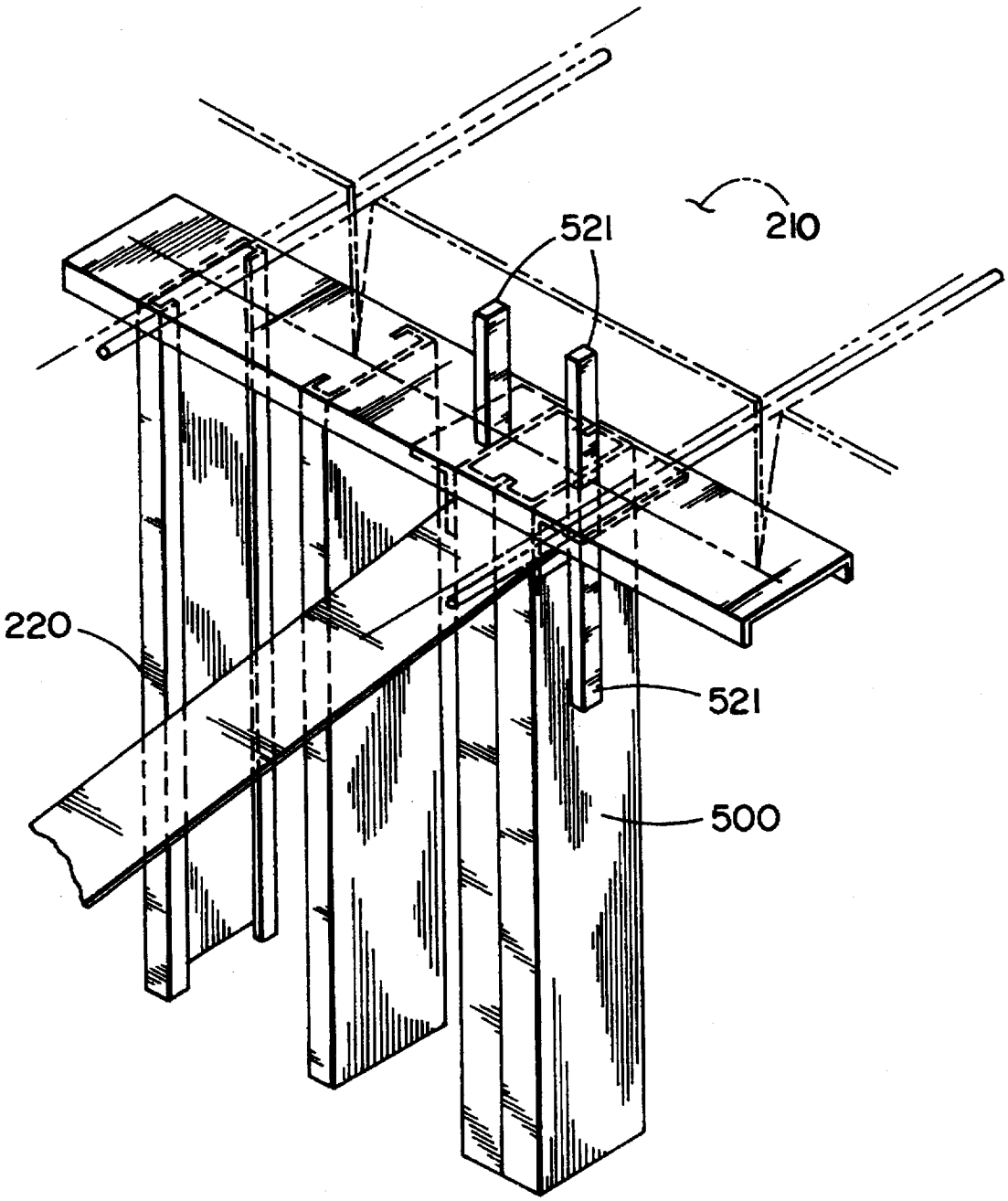
FIG. 6 is a view similar to FIG. 4 showing the improved connection between floors according to the present invention.

FIG. 6 and 7 show the improved flat swaps 521 of the present invention which take the place of the previously used threaded rods, nuts, washers, and bearing angles. Here, a pair of flat steel straps are welded to lower wind post 500 during prefabrication. During construction, the upper ends of the steel straps are welded to the lower portion of the upper wind post 500' as shown in FIG. 7.

Figure 8:
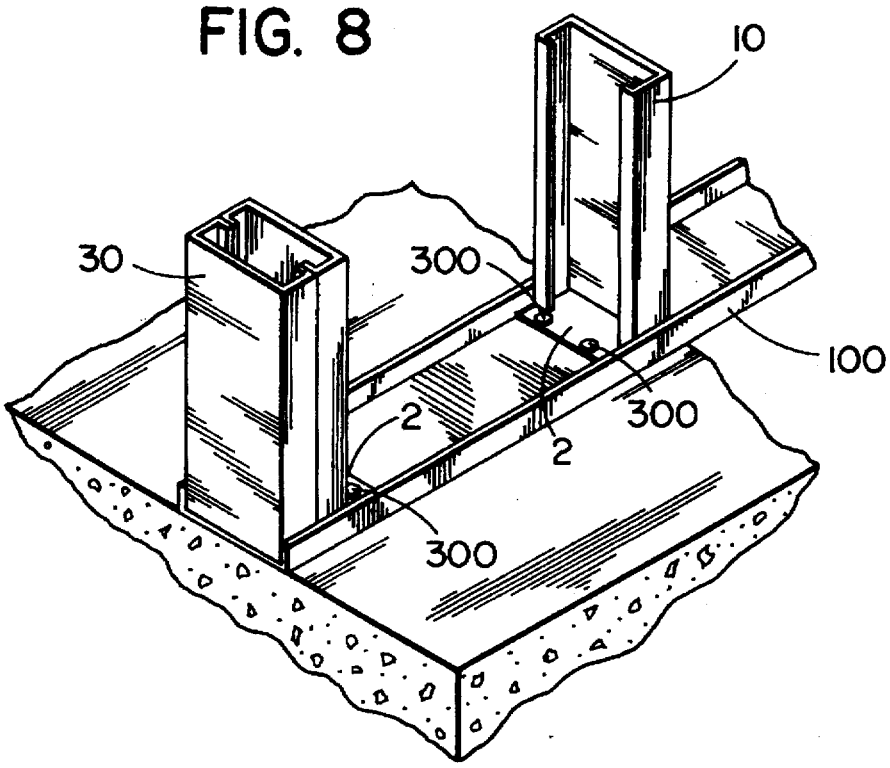
FIG. 8 is a broken, isometric view showing the attachment of a bearing wall to floor slab as taught by the parent application.
Figure 9:
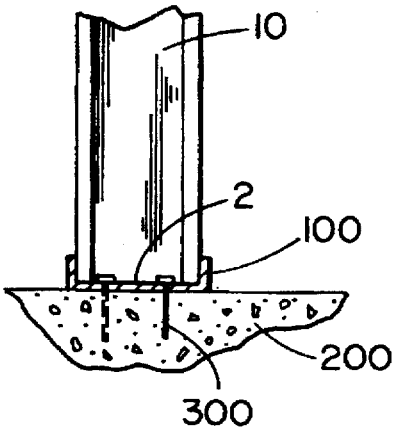
FIG. 9 is a broken, sectional view of the attachment shown in FIG. 8.
Figure 10:
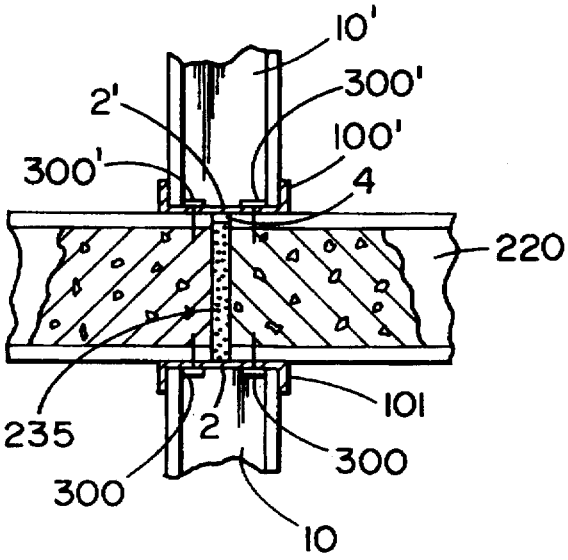
FIG. 10 is a broken, partially cut away, sectional view of the attachment of bearing walls above and below floor slabs according to the parent application.

FIGS. 8–10 show the attachment of the bearing studs and floor slabs as taught in the parent application. Bearing plates 2, located at the top and bottom of each stud, are attached to the foundation at the first floor by power actuated fasteners 300. At stud combination 30, provided at the end of the interior bearing wall adjacent the exterior of the structure, two studs face one another such that their flanges abut to form a tube. A bearing plate of twice the size of that placed beneath stud 10 is provided beneath stud 30 to provide for full bearing. In FIG. 9, the attachment of a bearing stud 10 at the first floor foundation is by means of two mechanical fasteners 300 penetrating through bearing plate 2 into the foundation 200. The power actuated fasteners 300 may be projected by a powder charge through the bearing plate 2 and the lower track 100 to fasten the stud wall to the foundation. This connection is similar to the connections at intersecting floors of multi-story structures in which the bottom of walls are attached to the hollow core slab floor system, such as shown in FIG. 10. FIG. 10 shows, in section, the attachment of a typical bearing stud at a wall-floor intersection of a multi-story supporting structure of the parent application. Mechanical fasteners 300, 300' extend through the bearing plates 2, 2', respectively, and through the web of the track 101, 100', respectively, into the hollow core slabs 210, 220 near butt joint 235. The power actuated fasteners are installed in two locations at the top of the slabs and two locations at the bottom of the slabs adjacent each stud.

Figure 11:
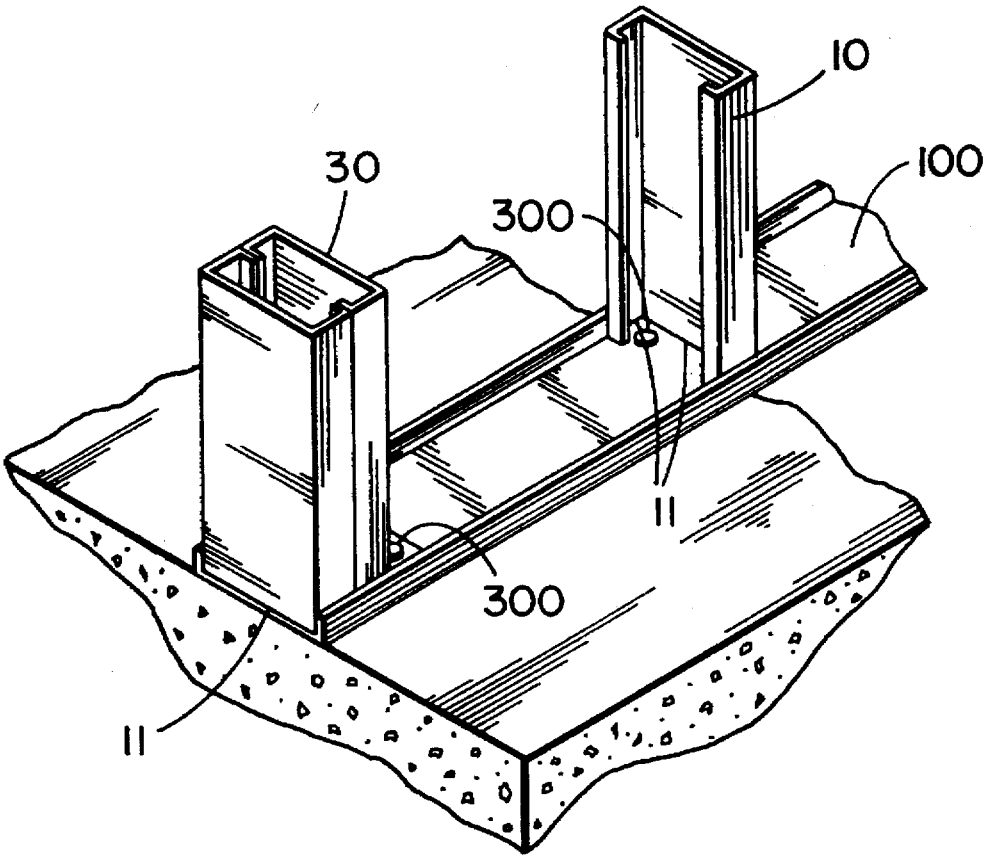
FIG. 11 is a view similar to FIG. 8 showing the improved track and stud connection according to the present invention.
Figure 12:
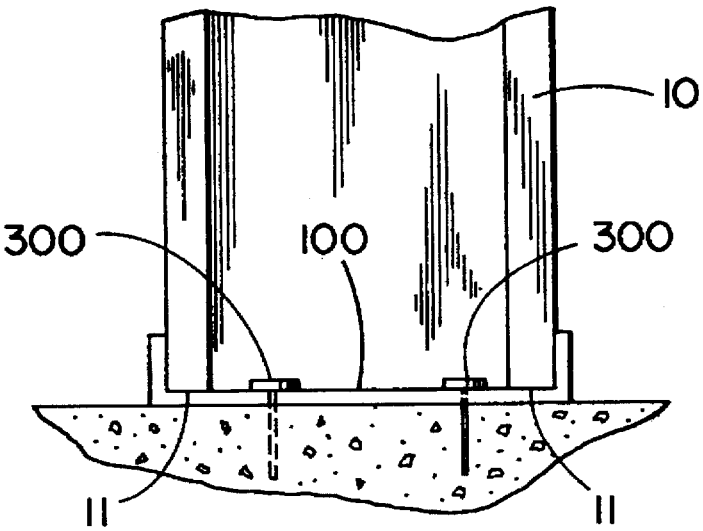
FIG. 12 is a view similar to FIG. 9 showing the improved track and stud connection according to the present invention.

The present invention eliminates the bearing plates 2, 2' and reduces the number of fasteners 300 as shown in FIGS. 11 and 12. Beating plates 2, 2' are eliminated by grinding the edges 11 at the ends of studs 10 (and 30) so that the ends of the studs fit snugly into the tracks 100. This is accomplished in a manner similar to the grinding of the edges of the bearing plates as described in the parent application. It has been discovered that by grinding the edges of the studs, the bearing plates can be eliminated. Moreover, by eliminating the bearing plates, there is no longer any need to apply two fasteners 300, 330' at each stud bearing plate. According to the present invention, a single fastener (e.g. 300) is provided at each stud through track 100, alternating in position as shown in FIG. 11.

Figure 13:
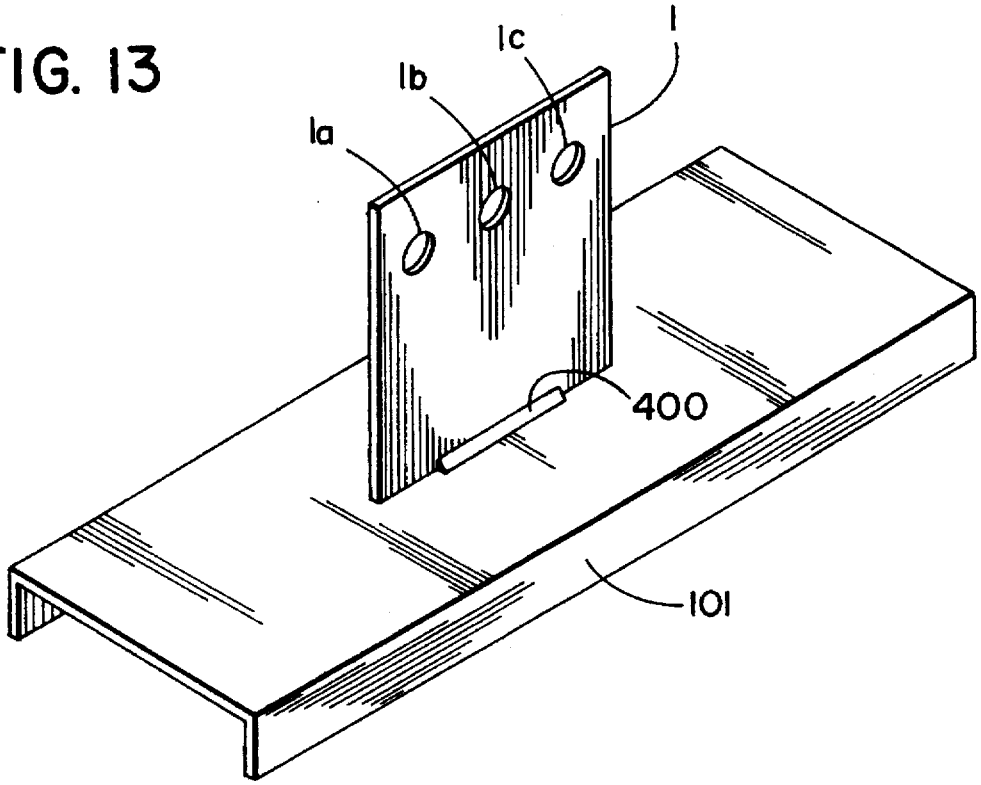
FIG. 13 is a broken, isometric view of the splice plate of the parent application.

A key component of the structure taught by the parent application is the splice plate 1 shown herein in FIG. 13. The splice plate is a vertical member welded to the top of track 101 and provided with a plurality of holes 1*a*, 1*b*, 1*c* for receiving reinforcing bars as described in the parent application. The plurality of holes are designed to accommodate several possible locations of a reinforcing bar as the alignment of splice joints, reinforcing bars and splice plates is often imperfect.

Figure 14:
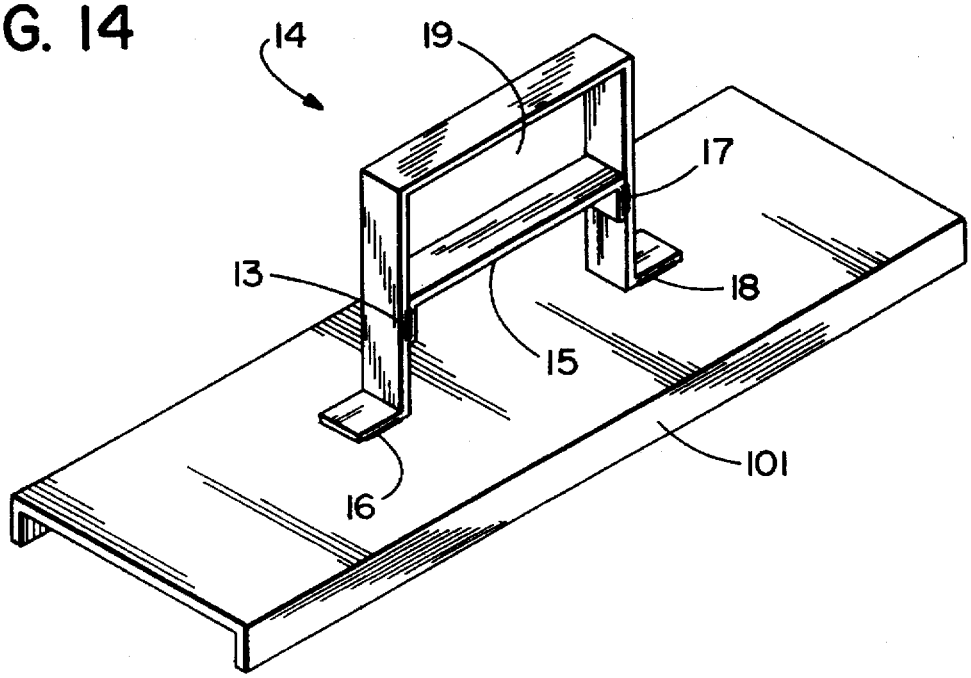
FIG. 14 is a view similar to FIG. 13 showing the improved open slide clip of the present invention.

The present invention substitutes an open slide clip 14 seen in FIG. 14 as a generally U-shaped member welded at points 16, 18 to the top of track 101. A cross member 15 welded to the vertical leg of clip 14 at points 13, 17 defines a broad opening 19 which takes the place of the several holes in the former splice plate. It will be appreciated that the broad opening 19 allows for greater deviation in the location of reinforcing bars. Additionally, the open slide clip is substantially lighter and less expensive than the former splice plate. After grout is placed in the opening, the U-shaped clip is totally encapsulated in the grout providing a more positive connection.

Figure 15:
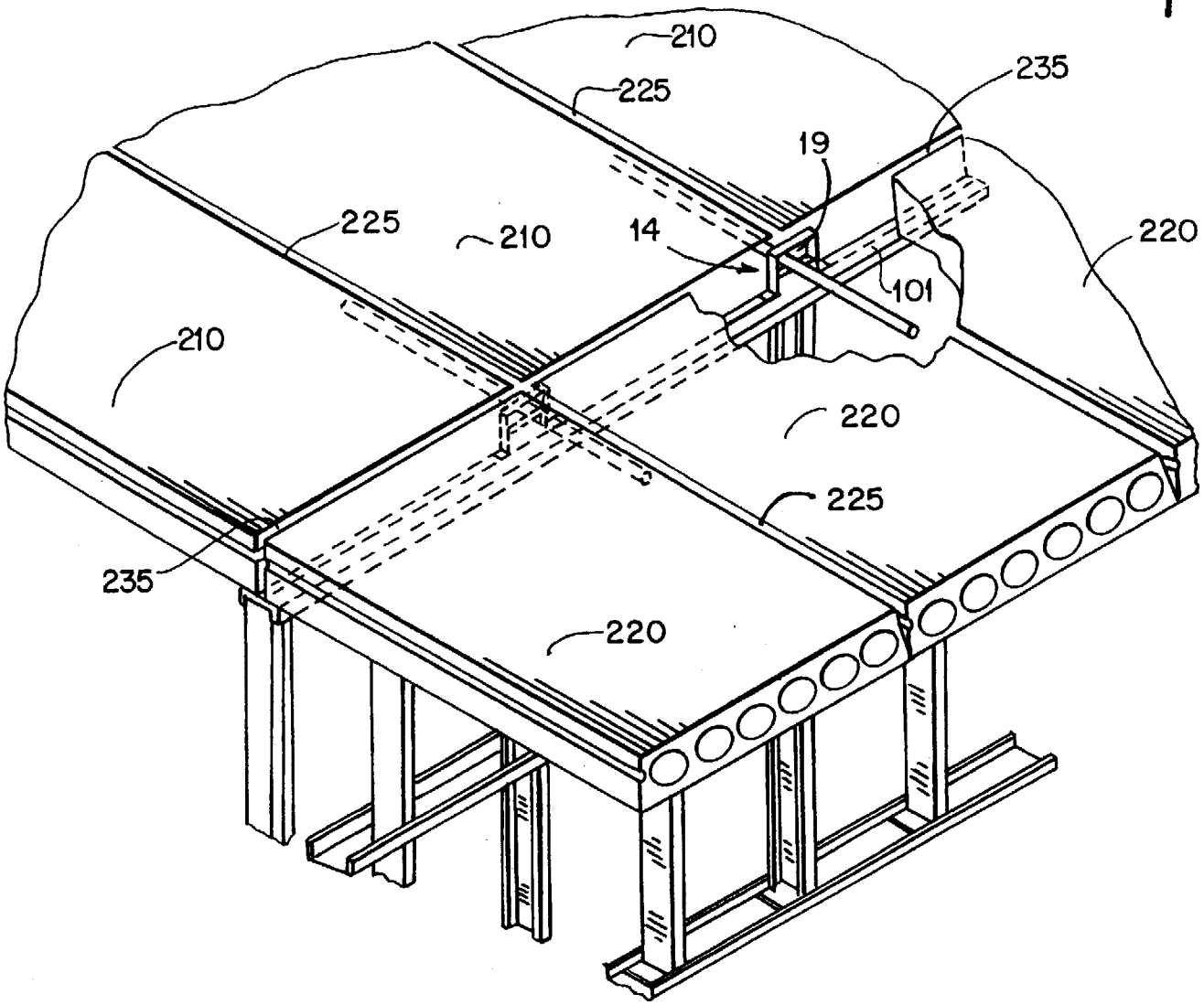
FIG. 15 is a partially constructed fragmentarily illustrated view of a wall panel constructed according to the present invention illustrating a plurality of slabs arranged with interposed longitudinal keyways and butt joints extending perpendicular to the keyways, and the wall panel having an inverted U-shaped member attached to the top track and having an opening aligning with a respective keyway.

More specifically, as shown in FIG. 15, the improved structural system for supporting a building having a horizontal floor member comprises a plurality of concrete slabs 210 and 220 arranged with interposed longitudinal keyways 225 and butt joints extending perpendicular to keyways 225. Each of the wall panels includes generally U-shaped open slide clip 14 attached to a top track 101. Open slide clip 14 includes a single broad opening 19 and a portion of broad opening 19 aligns with a respective keyway 225 so that a longitudinal reinforcing member or bar placed in a respective keyway 235 will pass into broad opening.

Although the foregoing description is directed to the preferred embodiments of the invention, it is noted that other variations and any modifications will be apparent to those skilled in the art, and may be made without departing from the spirit and scope of the present invention.

We claim:

1. An improved structural system for supporting a building comprising:

first and second horizontal floor members and a plurality of light weight steel framed bearing wall panels, each panel comprising a horizontal bottom track attached to said first horizontal floor member, a horizontal top track attached to said second horizontal floor member, and a plurality of vertical wall studs arranged at predetermined intervals between said top and bottom tracks;

said second horizontal floor member comprising a plurality of concrete slabs arranged with interposed longitudinal keyways and butt joints extending perpendicular to said keyways;

each of said wall panels including a vertically extending generally U-shaped member attached to said top track, said vertically extending member having a single broad opening, a portion of said broad opening aligning with a respective keyway so that a longitudinal reinforcing member placed in said respective keyway will pass into said broad opening.

2. An improved structural system according to claim 1, wherein:

said vertically extending member comprises an inverted U-shaped member welded to said top track.

3. An improved structural system according to claim 2, wherein:

said vertically extending member includes a cross bar welded to said inverted U-shaped member.

4. An improved structural system for supporting a building comprising:

a) first and second horizontal floor members and a first level of light weight steel framed bearing wall panels, each panel comprising a first horizontal bottom track attached to said first horizontal floor member, a first horizontal top track attached to said second horizontal floor member, a plurality of vertical wall studs arranged at predetermined intervals between said top and bottom tracks, and at least one double stud vertically extending between said top and bottom tracks; and b) a pair of vertically extending steel straps attached to opposite sides of said at least one double stud, said straps extending from a point below said top track to a point above said second horizontal floor member.

5. An improved structural system according to claim 4 wherein:

said straps are welded directly to said at least one double stud.

6. An improved structural system according to claim 5, further comprising:

a third horizontal floor member and a second level of light weight steel framed bearing wall panels, each panel comprising a second horizontal bottom track attached to said second horizontal floor member, a second horizontal top track attached to said third horizontal floor member, a plurality of vertical wall studs arranged at predetermined intervals between said top and bottom tracks, and at least one double stud vertically extending between said first horizontal top and said second horizontal bottom tracks; wherein said vertically extending steel straps are welded directly to said at least one double stud of said second level wall panels.

* * * * *